US008777225B2

(12) United States Patent
Dodds

(10) Patent No.: US 8,777,225 B2
(45) Date of Patent: Jul. 15, 2014

(54) PLAYING CARDS

(75) Inventor: Andrew Dodds, Sheffield (GB)

(73) Assignee: VX Enterprises Ltd, London (GB)

( * ) Notice: Subject to any disclaimer, the term of this patent is extended or adjusted under 35 U.S.C. 154(b) by 0 days.

(21) Appl. No.: 13/457,619

(22) Filed: Apr. 27, 2012

(65) Prior Publication Data

US 2012/0274026 A1 Nov. 1, 2012

(30) Foreign Application Priority Data

Apr. 28, 2011 (GB) ..... 1107125.5

(51) Int. Cl.
*A63F 1/02* (2006.01)

(52) U.S. Cl.
USPC ..... 273/295; 273/292; 273/293

(58) Field of Classification Search
CPC ..... A63F 1/02; A63F 1/00; A63F 1/067; A63F 2009/2451; A63F 2009/063; A63F 2250/302; G09F 23/14
USPC ..... 273/295, 292, 293; 156/60
See application file for complete search history.

(56) References Cited

U.S. PATENT DOCUMENTS 4,681,324 A * 7/1987 Karabed et al. ..... 273/295
5,654,050 A 8/1997 Whalen-Shaw

* cited by examiner

*Primary Examiner* — Michael Dennis
(74) *Attorney, Agent, or Firm* — Harness, Dickey & Pierce, P.L.C.

(57) ABSTRACT

A deck of playing cards wherein at least one card comprises a base layer that bears a front surface and a back surface and a substantially planar holographic optical element that is operatively configured to form a holographic image, the holographic optical element disposed at or towards a surface that is selected from the front and back surfaces the at least one card characterized in that the holographic optical element is of a type that is substantially transparent and manufactured to substantially prevent said holographic image from being viewed in a first range of directions with respect to the selected surface and to substantially enable said holographic image to be viewed from a second range of directions that are outside of the first range.

28 Claims, 9 Drawing Sheets

PLAYING CARDS

FIELD OF THE INVENTION

The present invention relates to playing cards that are widely available in decks of, for example, 52 or 54 cards. More particularly, but not exclusively, the invention relates to a playing card that is configured for use in a televised game of poker.

BACKGROUND OF THE INVENTION

As is known to those skilled in the art a conventional playing card comprises a piece of specially prepared heavy paper, thin cardboard, or thin plastic, configured with distinguishable markings (known as Indicia) and used as one of a set of 52 for playing card games. Playing cards are typically palm-sized for convenient handling. A complete set of cards is called a 'deck' and the subset of cards held at one time by a player during a game is commonly called a 'hand'. A deck of cards may be used for playing a great variety of card games, some of which may also incorporate gambling.

In general, tradition and conservatism bears quite heavily on the design of playing cards as are used in commercial gambling settings such as casinos, poker rooms and televised card game events such as televised poker.

The front surface of a given card carries markings that distinguish it from the other cards in the deck and these markings determine the use of the card under the particular rules of the game being played. The markings thus function as 'card identification elements' and typically comprise one of four suit indicia and one of thirteen value or 'pip' indicia. Thus a common variety of a deck of playing cards comprises the following suits: hearts, diamonds, clubs and spades. The respective cards of a suit are thus effectively numbered 1 through 13, the pip indicia thus typically comprising the relevant symbol 'A' for Ace, respective Roman numerals 2 to 10, 'J' for Jack, 'Q' for Queen and 'K' for King. A conventional deck of cards thus comprises 52 cards (or 54 when two additional cards known as 'Jokers' are included). The back of each card is typically of a design that is identical for all cards in any particular deck and this may thus be termed the base design. The base design may thus merely comprise the back surface being of a uniform colour without any pattern being involved. As is known to those skilled in the art the back faces of playing cards have, to date, sometimes been used for incorporating subject matter that is in addition to the base design. Such additional subject matter is known to comprise a variety of forms, such as, for example, images and/or text comprising alphanumeric characters. It is also known that such additional subject matter may relate to commercial information, such as, advertising information, concerning particular goods and/or services as are offered by a particular business entity. In professional card games, in contrast to the back surface, it is conventional to keep the front surface free of subject matter other than that relating to the value of the card. Thus unlike the back face it is generally required that the front face does not comprise subject matter which is of a type that is not directly related to the card value because such additional subject matter may crucially interfere with a player correctly recognizing the value of a given card.

Following a boom in popularity, arguably starting in 2003, poker has become a widely broadcast event on television, attracting large audiences worldwide.

FIG. 1 schematically illustrates, in perspective view, a typical prior art televised poker type setting 100, in which playing cards of a conventional type are in use on a known poker tournament table 101. Poker table 101 is associated with a playing surface 102 that is typically circular so that a number of players 104, 105, 106, 107 and 108 participating in the game are positioned around the table at roughly the same distance from a person 109 dealing the pack of cards (the 'dealer'). The majority of a pack of cards is generally indicated at 110 in front of dealer 109 on table 102.

Televised poker games have relatively recently gained great popularity with viewers worldwide and this is, in part, due to the invention of the so-called 'hole-card camera'. A hole-card camera is essentially a TV camera that is built into the construction of poker table 101 and which is configured to focus on the front surface of a hand of playing cards that are present on or near to the playing surface of the poker table. To achieve this a known configuration is such that the hole-card camera is positioned below the table surface and the cards are dealt onto a window type area of surface 102 (typically made of a transparent material such as glass) such as that indicated at 111 as is positioned for use in relation to player 106. Thus as player 106 is dealt cards these are positioned on window region 111 so that the hole-card camera below can view the value of the cards that have been received. The hole-card camera thus electronically images these cards and electronically transmits the images so that an audience (watching the game on television) can see the value of the cards. Each player is thus associated with a respective window of the type 111 and a hole-card camera located beneath table surface 102.

Typically poker table 101, players 104 to 108 and dealer 109 are located in a suitable lighting environment such as the lighting environment that is generally indicated at 113. Lighting environment 113 comprises a plurality of suitably positioned lighting devices (lamps) such as those indicated above table 101 at 114 and 115. In addition, above poker table 101, there is also typically provided a television camera arrangement so that filming (image recordal) may be performed from above. In FIG. 1 a television camera 116 is shown as positioned to film player 104 to the right of the figure and camera 116 is located on and moveable about a circular rail 117 so as to capture images of the game as it progresses below in relation to the players and dealer who are located around table 101.

FIG. 2A further details, in side elevation/cross section view, the known poker tournament table 101 of FIG. 1 and it illustrates the relative position of player 106 with respect to window 111 on surface 102 of poker table 101. A hole-card camera as referred to above in relation to FIG. 1 is schematically illustrated at 201 in a position below surface 102 in order to view and image window region 111. Window region 111 is illuminated from underneath table surface 102 by virtue of a suitably configured lighting device, such as, for example, a lamp 202. Illumination device 202 is substantially located in front of player 106 and configured to illuminate the underside of window region 111 so that camera 201 can effectively and clearly view one or more cards that are positioned on window region 111. By way of example a card 203 is shown in FIG. 2A as located on window region 111. In the example card 203 is facing down such that the face comprising indicia is facing surface 102.

FIG. 2B further details, in perspective view from above poker table surface 102, player 106 and window region 111 as viewed by camera 116 located above table surface 102 and above head height of the dealer and players.

As with many sporting and/or gaming type events that are shown on television sets and the like via broadcasting, cable or satellite, incorporation of information, such as, for example, advertising information, on the images that are viewed by persons watching is generally highly desirable. As such there is a constant desire to provide new devices, mechanisms and systems for facilitating the transmission of such information to the viewers of such events. Notwithstanding this desire there are certain types of events that are hindered in this regard by virtue of professional requirements of various kinds. A good example of the latter is the game of poker and the problems associated with televised poker are described below.

As mentioned above, televised poker games have relatively recently gained great popularity with viewers worldwide and this is, in part, due to the invention of the so-called 'hole-card camera'. Known hole-card cameras capture and transmit images of the game as viewed by the cameras. In card games, such as poker, the focus of the attention of the players and any spectators is predominantly on the front surfaces of the playing cards, because the front surface of a card specifies the value of the card. Use of the hole card camera in televised poker event production lends itself to potentially exploiting a satisfactory means of incorporating desirable additional subject matter, such as, for example, images and/or alphanumeric text on one or both of the surfaces of playing cards. Such desirable subject matter may, for example, comprise commercial information of one sort or another such as advertising information. By 'additional subject matter' it is herein meant, in relation to the front surface of a playing card, subject matter that is in addition to the card identification subject matter. If desirable additional subject matter could be satisfactorily incorporated on playing cards and, in particular on the front surface of a playing card, used in a televised card game there would thus be provided a means of transmitting such additional subject matter to the customers/viewers of the event via the images of the game that are captured by and transmitted by a suitably configured imaging device such as a television camera. The problem is that the desirable additional subject matter to be captured and transmitted must be such that its presence is satisfactory from the point of view of the player or players of the card game. By satisfactory it is meant that the additional subject matter must be specifically concealed or impeded from the viewpoint of the card player or players at critical junctures of the game. As is known to those skilled in the art arguably the most critical juncture of the game for the players of a poker game is the point at which they first view their hole cards.

Currently the front surfaces of cards used in televised poker events are generally not used for displaying information such as information for advertising purposes because this would necessitate some alteration to the recognizable and traditional ink markings (indicia) which distinguish each card in the deck or at least would involve inclusion of such information elsewhere on the front surface. Incorporation of desirable information, for example, advertising information, achieved either through modifications to these ink markings or through modifications to other regions of the front surface of the cards, would therefore interfere with the players ability to quickly and easily recognize his/her holding and would thus be particularly inappropriate in formal and competitive game-play settings where stakes can be very high, such as modern televised poker tournaments. In view of this, there exists a technical problem with known playing cards as are currently used in televised poker and the like in that incorporation of additional information of one sort or another on the playing card front surfaces is highly undesirable because of the fact that known devices, mechanisms and systems for achieving this interfere with a player's ability to recognize a given card quickly and accurately.

Improved types of playing cards have been developed for various purposes over the years. Two examples are discussed as follows.

U.S. Pat. No. 5,654,050 in the name of Whalen-Shaw was published on Aug. 5, 1997 and relates to a laminated playing card (and a method of making a playing card) that aims to combine the most favourable features of both paper and plastic playing cards. The cards in accordance with U.S. Pat. No. 5,654,050 are, as compared with the desire to solve the aforementioned technical problem, thus merely configured to improve the durability, while at the same time not reducing the stiffness, or 'snap', as is known in the art, of the playing cards.

U.S. Pat. No. 4,681,324 in the names of Karabed Razmik and Mehrbians Raphael is entitled 'Holographic Game Cards' and has a publication date of Jul. 21, 1987. U.S. Pat. No. 4,681,324 discloses playing cards wherein a part of or the whole of a given indicia is formed as a holographic image.

Holography is a form of optical information storage. A hologram is sometimes referred to as an OVD, or 'optically variable device', by those in the art. Although the cards according to U.S. Pat. No. 4,681,324 provide benefits in certain gaming environments they do not offer a solution to the aforementioned technical problem because they in fact provide the opposite effect to that which is sought. In other words, as those skilled in the art will understand the central aim of playing cards according to U.S. Pat. No. 4,681,324 is to permit a player of a card to see information (in particular the indicia, made up of holographic images) on the card whilst specifically preventing other parties (other players and spectators) from doing so.

As those skilled in the art will appreciate it is also noteworthy that, given the filing and publication dates of U.S. Pat. No. 4,681,324 and the descriptions of the embodiments, although not specifically stated as such, the holographic technology relied on is of the type where a reflective metal type backing is integrally present in order to provide the holographic images. As such, playing cards as are configured in accordance with U.S. Pat. No. 4,681,324 inherently interfere with the recognizable and traditional appearance of the front surface indicia markings of the card and thus interfere with a given player's ability to quickly and accurately identify the card at critical junctures of the game.

In view of the above there is thus a need for an improved deck of playing cards that comprises a form of playing card that overcomes the aforementioned technical problem and which is therefore satisfactory for use in televised card games.

SUMMARY OF THE INVENTION

An object of the present invention is to provide a deck of playing cards comprising at least one playing card that comprises a holographic image that is contained within a substantially transparent holographic optical element.

A further object of the present invention is to provide a playing card that comprises a holographic image such that (a) the holographic image is visible, given suitable relative positioning of a light source, an electronic image receptor and the face of the card that is being imaged, to the electronic image receptor, in particular a TV camera, at a first juncture of a card game and (b) such that the holographic image is not visible to the eyes of a player in whose card hand the card subsists when the player views the card at a different juncture of the game.

A further object of the present invention is to provide a poker playing card that comprises a holographic image such that the holographic image is substantially not visible to a player who checks the value of the card at a particular stage of a poker game, but such that the holographic image is visible to one or more image receptors at one or more different stages of the game.

Yet a further object of the present invention is to provide a playing card for use in a card game, the card comprising a base layer having a face that is associated with indicia markings and an additional layer that comprises a substantially transparent holographic optical element layer that comprises a holographic image, the card configured such that at a particular stage of the proceedings of the game the holographic image is substantially not viewable by a player in whose card hand the card subsists thereby affording the player with a substantially uninterrupted view of the indicia markings on the surface of the base layer.

According to a first aspect of the present invention, there is provided a deck of playing cards wherein at least one card comprises:

a base layer that bears a front surface and a back surface; and a substantially planar holographic optical element that is operatively configured to form a holographic image, said holographic optical element disposed at or towards a surface that is selected from said front and back surfaces;

said at least one card characterised in that:

said holographic optical element is of a type that is substantially transparent and manufactured to substantially prevent said holographic image from being viewed in a first range of directions with respect to said selected surface and to substantially enable said holographic image to be viewed from a second range of directions that are outside of said first range.

Preferably at least one of said surfaces bears one or more card identification elements configured to distinguish the card from other cards in the deck.

Preferably at least one of said surfaces bears one or more card identification elements configured to distinguish the card from other cards in the deck and said holographic image is formed on the same side of said card as that which bears one or more card identification elements.

Preferably at least one of said surfaces bears one or more card identification elements configured to distinguish the card from other cards in the deck and said one or more card identification elements substantially do not form part of said holographic image.

Preferably at least one of said surfaces bears one or more card identification elements configured to distinguish the card from other cards in the deck and said holographic image substantially comprises an image of an entity other than of said one or more card identification elements.

Preferably said holographic optical element is specifically not associated with a metallised backing layer.

Preferably said base layer is substantially made of a material from the set comprising plastics, paper and cardboard.

Preferably said holographic optical element comprises a surface having specially configured undulations that facilitate formation of said holographic image.

Preferably said holographic optical element is substantially planar.

Preferably said holographic element is substantially in the form of a layer having substantially the same dimensions as said base layer.

Preferably said holographic optical element comprises a high refracting index (HRI) medium as part of its construction.

Preferably said holographic optical element substantially comprises a photopolymer based medium as part of its construction.

Preferably said holographic optical element substantially comprises a selectively de-metallised based medium as part of its construction.

Preferably at least one of said first and second ranges are, during manufacture of said at least one card, substantially predetermined and said optical element is configured to provide said specified visibility requirements of each respective range in accordance with a substantially predefined relative positional arrangement as between said selected card surface, a light source and an image receptor.

Preferably said second range of directions is substantially symmetrical with respect to a reference direction that is perpendicular to said selected surface.

Preferably said second range of directions comprises, with respect to a reference direction that is perpendicular to said selected surface, the set of angles that are at 45 degrees or less to said reference direction.

Preferably said first range of directions comprises the set of directions that subtend an angle of 45 degrees or less to the tangential plane of a point as is viewed on said selected surface.

Preferably said holographic optical element is mechanically embossed on its outer surface in order to reduce gloss.

Preferably said deck of cards is configured for use in a card game that is electronically imaged for transmission to an audience of one or more spectators.

Preferably said deck of cards is configured for use in a televised card game.

Preferably said deck of cards is configured for use in a professional card game.

Preferably said deck of cards is configured for use in the game of poker.

Preferably said holographic image comprises a sign that is configured to distinguish goods and/or services of a first commercial undertaking from those of other commercial undertakings.

Preferably said sign comprises one or more alphanumeric characters.

Preferably said card is configured such that said first range of directions comprises a subset of directions that are used by a player in a card game during the process of said player initially viewing and checking the value of said card, said process comprising, from a starting position wherein said card is lying face down, said card being handled by said player such that an edge portion of said card is brought into said subset of directions with respect to the direction that said card is viewed by said player, said subset of directions specifically being directions that in accordance with associated predetermined lighting conditions render said holographic image as substantially invisible to the eyes of said player.

Preferably said card is configured such that said second range of directions comprises a subset of directions outside of said first range that are used by an electronic image receptor, said subset of directions of said second range specifically being directions that in accordance with associated predetermined lighting conditions render said holographic image as substantially visible to said electronic image receptor.

According to a second aspect of the present invention there is provided a playing card comprising:

a base layer that bears a front surface and a back surface; and a substantially planar holographic optical element that is operatively configured to form a holographic image, said holographic optical element disposed at or towards a surface that is selected from said front and back surfaces;

said card characterised in that:

said holographic element is of a type that is substantially transparent and manufactured to substantially prevent said holographic image from being viewed in a first range of directions with respect to said selected surface and to substantially enable said holographic image to be viewed from a second range of directions that are outside of said first range.

Preferably said card is configured such that said first range of directions comprises a subset of directions that are used by a player in a card game during the process of said player initially viewing and checking the value of said card, said process comprising, from a starting position wherein said card is lying face down, said card being handled by said player such that an edge portion of said card is brought into said subset of directions with respect to the direction that said card is viewed by said player, said subset of directions specifically being directions that in accordance with associated predetermined lighting conditions render said holographic image as substantially invisible to the eyes of said player.

Preferably said card is configured such that when said card is used in a card game said second range of directions comprises a subset of directions outside of said first range that are used by an electronic image receptor, said subset of directions of said second range specifically being directions that in accordance with associated predetermined lighting conditions render said holographic image as substantially visible to said electronic image receptor.

According to a third aspect of the present invention there is provided a method of making a playing card comprising a holographic image, said method characterised by comprising the steps of:

selecting a conventional playing card as a base layer;

selecting a substantially transparent holographic optical element;

selecting a required holographic image;

constructing said substantially transparent holographic optical element with said required holographic image, said optical element manufactured to substantially prevent said holographic image from being viewed in a first range of directions with respect to the plane of said base layer and to substantially enable said holographic image to be viewed from a second range of directions that are outside of said first range;

selecting the surface of said selected base layer with which to associate said substantially transparent holographic optical element; and selecting an adhesive and using said adhesive to affix said substantially transparent holographic optical element to said base layer.

Preferably said step of constructing said substantially transparent holographic optical element comprises the step of setting impeded and unimpeded viewing angles.

Preferably upon completion of said card, said card is configured such that said first range of directions comprises a subset of directions that are used by a player in a card game during the process of said player initially viewing and checking the value of said card, said process comprising, from a starting position wherein said card is lying face down, said card being handled by said player such that an edge portion of said card is brought into said subset of directions with respect to the direction that said card is viewed by said player, said subset of directions specifically being directions that in accordance with associated predetermined lighting conditions render said holographic image as substantially invisible to the eyes of said player.

Preferably upon completion of said card, said card is configured such that when said card is used in a card game, said second range of directions comprises a subset of directions outside of said first range that are used by an electronic image receptor, said subset of directions of said second range specifically being directions that in accordance with associated predetermined lighting conditions render said holographic image as substantially visible to said electronic image receptor.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

Figure 1:
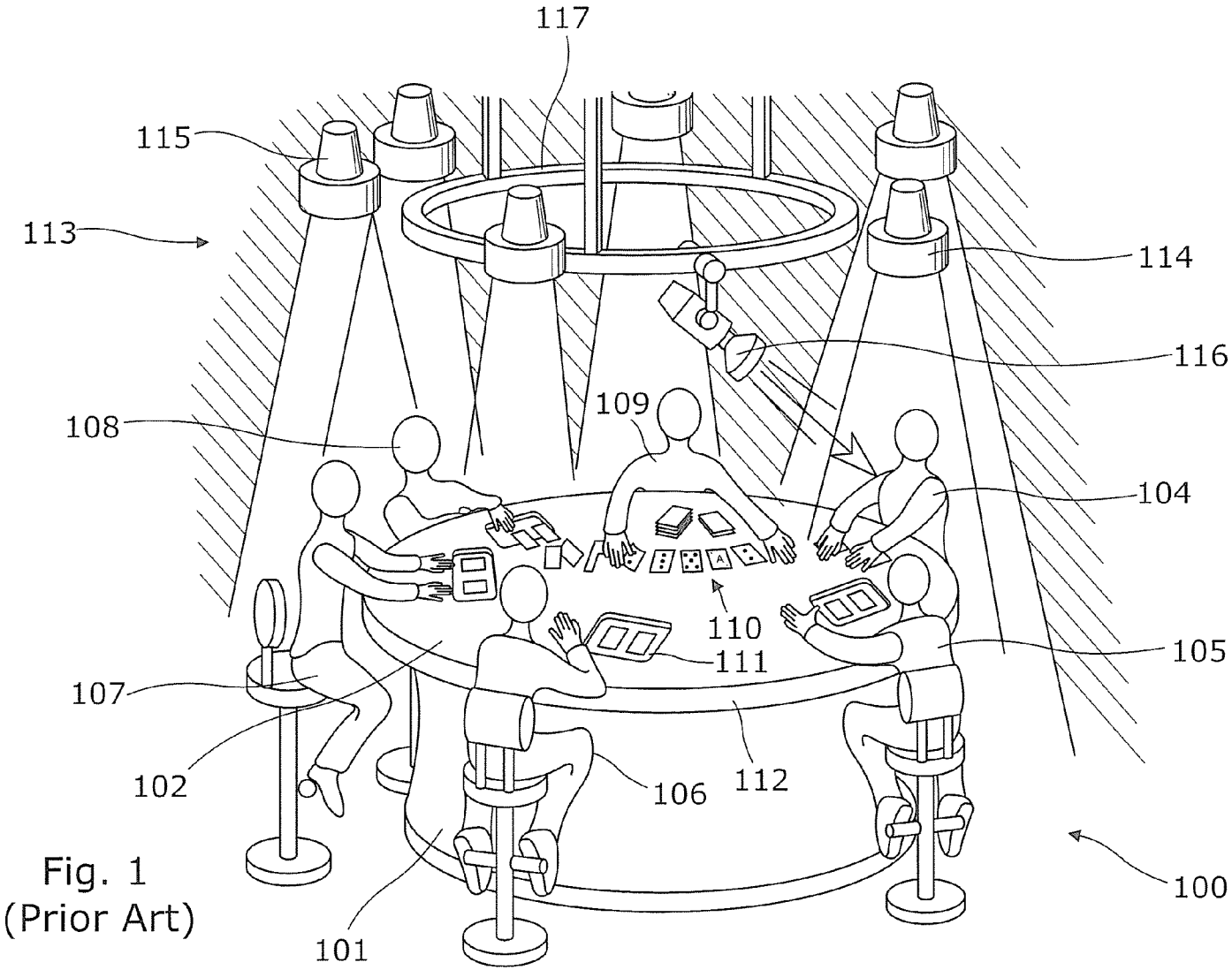
Fig. 1 (Prior Art)
FIG. 1 schematically illustrates, in perspective view, a typical prior art televised poker type setting, in which playing cards of a conventional type are in use on a known poker tournament table.

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

The following description concerns playing cards as configured in accordance with the present invention for use in games such as poker. However, the specific examples used for illustration are not to be considered as limited to the game of poker.

According to the best mode of the present invention a playing card is provided that comprises a substantially conventional base card that is printed with traditional markings on the front and back surfaces. Thus the front surface comprises one or more card identification elements or "indicia" configured to distinguish the card from other cards in the deck. However, in contrast to known playing cards, a playing card as configured in accordance with the present invention comprises a transparent or a substantially transparent holographic optical element. Preferably a transparent or substantially transparent holographic optical element is disposed adjacent to and above the front surface of the base card. The present invention makes use of a transparent or a substantially transparent holographic optical element. Hereinafter the term "substantially transparent holographic optical element" is to be taken as meaning a holographic optical element that is transparent or substantially transparent and this definition is to be so-construed in relation to the appended claims. More particularly by "substantially transparent" it is herein meant that the holographic optical element is of a type that either does not comprise a reflective backing layer of a type that is typically made of a metal such as aluminium or is at least structured such that such a layer has been substantially demetallised. Such a substantially transparent optical element is advantageous in relation to the present invention because it enables markings on the surface of the base layer of the card to be viewed from looking above and though the optical element that is affixed above the base layer of the card.

As indicated above, in accordance with the best mode of the present invention, a traditional card surface is, as far as the viewable markings are concerned, substantially unchanged compared with known playing cards. Notwithstanding this, the substantially transparent holographic optical element or elements referred to is/are provided in order to afford a substantially impeded view of a holographic image in a first range of directions with respect to the surface of the card that is selected (front or back surface) and to afford a substantially unimpeded view of the holographic image in a second range of directions that are outside of the first range. In other words besides the traditional printed material present on a given surface of a card the substantially transparent holographic optical element functions to enable the card to comprise a holographic image that may or may not be viewed depending on the relative positioning of the selected card surface and a lighting source and the viewing angle of an associated image receptor. Suitable relative positioning and unsuitable relative positioning as far as viewing the holographic element is concerned, is determined at the original hologram creation/manufacture stage. Typically the holographic image may thus be viewed by using a light source to provide light to the holographic optical element from approximately the same angle at which a laser beam was used during manufacture to construct a given holographic plate that is then subsequently used to make the required holographic optical elements that comprise the holographic image as required.

In accordance with the present invention such a holographic image may comprise one or more of a variety of types of image, such as, for example, images comprising advertising slogans, logos, customized artwork and/or personalized artwork. The visibility of the holographic image can therefore be manipulated depending on certain conditions relative to the card bearing the holographic image such as viewing angles, lighting angles and the like. Such conditions may be arranged for a stage-managed and professionally produced card game event, such as a televised poker game, by suitable relative arrangements (as are determined during card manufacture) of one or more light sources and TV cameras at the appropriate predetermined relative angles around a surface of a poker table that is being prepared for a given poker game event.

The types of holographic members that are made use of in the present invention are, in the art of commercial holography, commonly known as "transparent type holograms" or "transparent holograms". Such a term is somewhat vague because, as will be understood by those skilled in the art, all holograms are transparent as such. Hence in the present description the terms "substantially transparent holographic member" and "substantially transparent holographic optical element" are used (interchangeably) in order to clarify that it is the entire construction of the medium, comprising interference fringes, that is substantially transparent as opposed to the holographic image that is produced (i.e. played back). This clarification is required so as to distinguish such holographic members as are used in the present invention from holograms that have existed for a substantially greater period of time in the history of holography, the latter comprising within their construction a reflective backing layer in the form of a metallised layer that is typically, for example, made of aluminum foil. Such a reflective metal backing layer provides a surface that reflects light back to the viewer and enables replay of the hologram, in order to form the desired holographic image. As those skilled in the art will appreciate such a metal reflective backing layer is substantially opaque, that is, it is not transparent, nor substantially transparent. As such a holographic optical element consisting of a metallised layer would totally or substantially prevent the markings on a given base card surface located behind the metallised layer from being viewed. This latter situation effectively constitutes a major technical problem that the present invention solves.

As those skilled in the art will appreciate, in contrast to the 1980's, there are now a number of types of substantially transparent holographic optical elements that are commercially available. As those skilled in the art of holography will appreciate the development of substantially transparent holographic optical elements has been driven by their applications in the security and anti-counterfeiting industries and they first originated in the late 1980's. A first commercially available type of substantially transparent holographic optical element is that comprising a high refractive index (HRI) layer and this represents the best mode contemplated for realising the present invention. This type of holographic optical element typically comprises of sputtered or vacuum-coated metal oxides and sulphides or refractive inorganic compounds (for example, titanium dioxide and/or zinc sulphide) and works on the basis of light refraction. Furthermore, in contrast to the metallised type of holographic members wherein light that is used to reconstruct the hologram is provided by direct reflection on a metal backing, HRI transparent type holographic optical elements instead rely on the property of refraction of light by a transparent medium of higher refractive index than the hologram recording medium. This approach has the effect of re-directing the light back through the interference fringes of the holographic element, thus producing a visible holographic image. As far as the inventor of the present invention is aware the first commercial application of a substantially transparent holographic optical element, as applied onto a substantially opaque base layer, related to use, in the early 1990's, on passports of the United Arab Emirates.

In accordance with the best mode contemplated the substantially transparent type holographic optical elements used in the present invention are of the type known as surface relief holograms. Surface relief holograms comprise minute and substantially regular undulations on the surface of the holographic member thus creating a surface relief interference pattern. As will be understood by those skilled in the art the surface relief interference pattern is configured to diffract visible incident light in order to form a holographic image that can be seen, from certain pre-defined angles/directions, by a given viewer. Such surface relief holograms may be replicated on commercial scales through the pressing or 'embossing' of the surface relief interference pattern that holds the design detail of a given holographic image into a suitable material forming the body of the holographic medium. Hence the finished replicated holographic elements are known in the art as 'embossed holograms'. A suitable material that is commonly used is, for example, polyester.

In an alternative embodiment of the present invention another suitable type of transparent or substantially transparent holographic member is that configured from a transparent or substantially transparent photopolymer member. This type of substantially transparent holographic member has a number of different properties to a HRI type transparent holographic member, but shares the properties of substantial transparency and visibility of the holographic image from the same side as the light source, both of these properties being fundamental to the present invention. Photopolymer based holograms are typically recorded within the body of the material, such that the light-diffracting interference fringes are parallel to the structure. Replication of photopolymer type holograms is achieved by exposure to the "master image" with the use of a laser beam, rather than the "pressing" reproduction method used for embossed (surface relief) type holograms discussed above.

In a further alternative embodiment of the present invention another suitable type of transparent or substantially transparent holographic member is that configured from a transparent or substantially transparent selectively de-metallised member.

As will be understood by those skilled in the art, other types of substantially transparent holographic members are therefore known. However, the HRI type is, as far as the inventor of the present invention is aware, currently the best mode contemplated in view of the fact that they are commercially viable for use in mass production this being largely due to ease of replication and therefore relatively low associated production costs.

A key property of playing cards as configured in accordance with the present invention is that all layers of the card construction are transparent or substantially transparent save for the base card layer located within or otherwise comprised as a part of the card's construction. Thus to all intents and purposes a playing card as configured in accordance with the present invention will, at least from certain predetermined viewing angles and associated predetermined required lighting conditions, appear substantially like a traditional playing card in terms of the front face (comprising indicia) and the back face comprising a pattern that is the same for each card in the deck that the card is a member of. As is known to card players the same identical pattern for each card is required so that the value of a given card may not be identified from viewing the back surface of the card.

Figure 3:
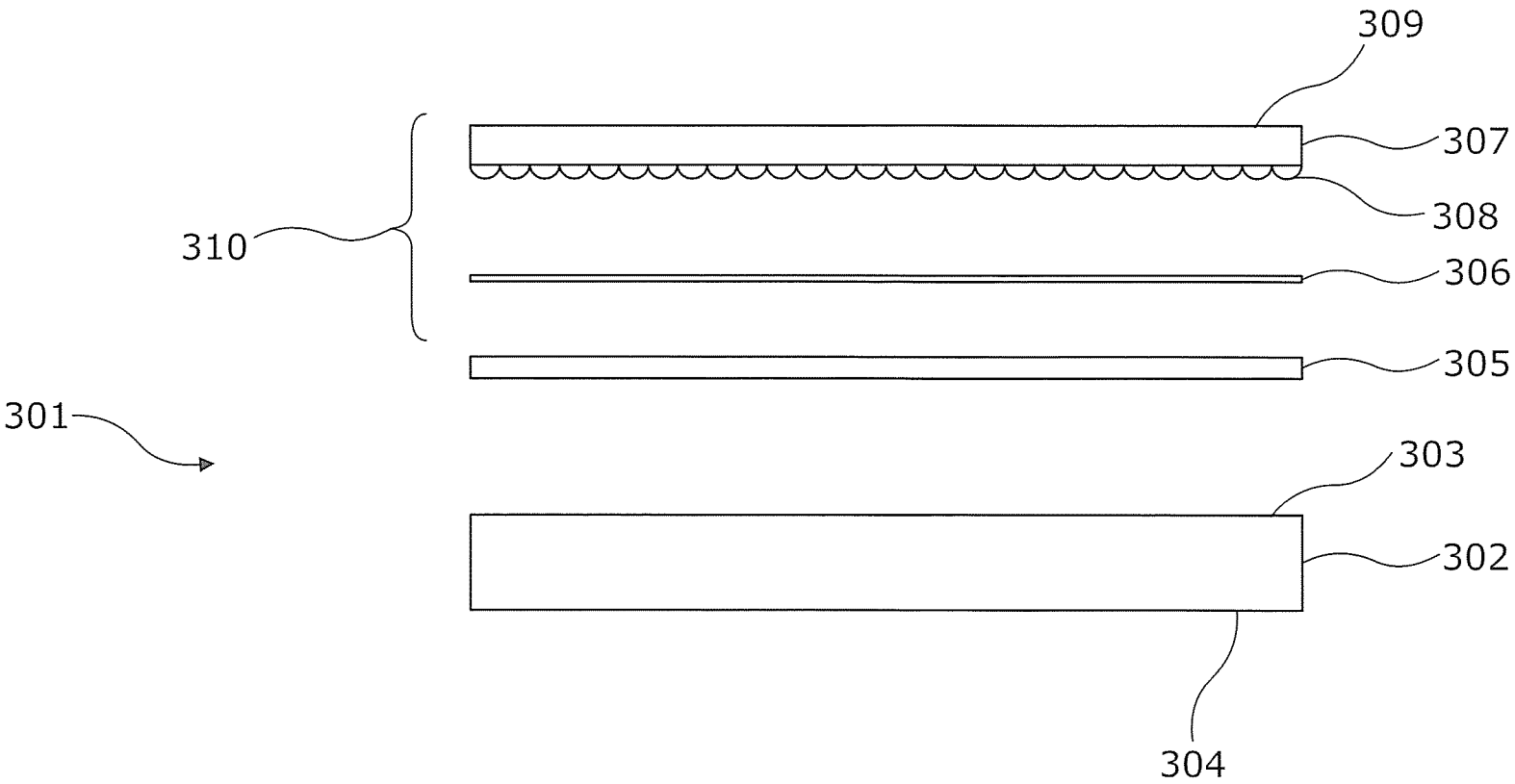
FIG. 3 schematically illustrates, in cross-section view, a preferred layered construction of a playing card as is configured in accordance with the present invention, the card comprising a substantially transparent holographic optical element that comprises a holographic image.

FIG. 3 schematically illustrates, in cross-section view, a first preferred layered construction of a playing card 301 as is configured in accordance with the present invention. In order to aid illustration the card layers are shown as separated from one another although in reality they are located adjacent to each other in a compact integral form so as to provide a card that is suitable for game playing. In other words card 301 is shown in an exploded view in order to more clearly distinguish each respective layer from the next. Card 301 comprises a base layer 302 having a front surface (front face) 303 and a rear surface (back face) 304. Front face 303 comprises printed material of a type that is typically found on the front face of a conventional playing card and thus comprises one or more card identification elements (indicia) configured to distinguish the card from other cards in a deck of cards of which the card is a member. Back face 304 comprises printed material that, in common with a conventional playing card, comprises a pattern that essentially renders the card, when viewed at this face, indistinguishable from other cards in the deck. Located adjacent to front face 303 there is provided a primer layer 305 of a suitably configured adhesive that is substantially transparent. In this way adhesive layer 305 does not obscure the indicia located on front surface 303 from view by a person viewing the card from the front. Above adhesive layer 305 there is provided a high refractive index layer 306 that is located adjacent to adhesive layer 305. Above layer 306 there is provided an outer layer 307 which comprises, on its underside, a surface relief pattern 308. Thus the outermost surface of the playing card on the side that is configured for viewing the indicia is provided by the upper surface 309 of outer layer 307. Collectively layers 306 and 307 thus constitute a substantially transparent holographic optical element in the form of an overlay 310 that is affixed to the indicia bearing surface of base card 302 and the value of the card on surface 303 may be viewed from observing the card from above layer 309. Overlay 310 constitutes a substantially transparent laminate and the embossments or surface relief pattern that creates the holographic image are located between HRI layer 306 and the relatively thin transparent outer layer 307. Outer layer 307 is suitably made of a transparent plastics based material, which remains on the outside face as part of the construction of playing card 301. The outer layer 307 is, in the best mode, compromised of a suitable plastics based material and as those skilled in the art will understand suitable materials include: Polyethyleneterephthalate (PET), Polyvinyl Chloride (PVC) and/or Biaxially Orientated Polypropylene (BOPP). The surface relief pattern 308 may be formed in a layer that is, during manufacture, initially separate from and subsequently permanently affixed (by adhesive) to layer 307 or it may be formed as part of layer 307. Thus the surface relief pattern layer (embossed layer) may comprise of, for example, one or more of the following: PET, Polypropylene, Cellophane, Acetate, Nylon, Polyamide, Polyamide-imide, Polyether Sulfone and Polyether Ether Ketone. The high refractive index layer 306 suitably comprises one or more materials from the following: Titanium Dioxide, Zinc Sulphide, Iron Oxide, Lead Oxide, Zinc Selenide, Cadmium Sulphide, Titanium Oxide, Lead Chloride, Cerium Oxide, Tantalum Oxide, Zinc Oxide and Neodymium Oxide.

The purpose of the adhesive layer 305 is to ensure that, when the card is in use in a card game, the laminate overlay 310 does not detach from base layer 302. The particular adhesive used will depend on the nature of the material that the base layer is made of and, as will be appreciated by those skilled in the art, may be selected accordingly. Typically base layer 302 may be made of paper or cardboard although various other materials such as, for example, Cellulose Acetate, PVC or another suitable plastics-based material may be used.

Although the preferred embodiment described above in relation to FIG. 3 employs a HRI layer as part of the construction, other forms of construction comprising transparent or substantially transparent layers in order to construct a substantially transparent holographic optical element may be used. Thus other types of suitable construction include, for example, photopolymer based substantially transparent optical elements and so-called selectively de-metallised substantially transparent optical elements.

In order to effectively describe the best mode contemplated as to the application of the present invention in a televised poker game an exemplary sequence of actions occurring in a typical single hand of a poker game is now described. In the case described in detail below, the format is known as 'Texas Hold 'em Poker'. As those skilled in the art of poker will appreciate this format is currently the most popular format of the game and it represents the format that is predominantly shown on television. The present invention will however have a similar application and effect in other televised formats of the game of poker and in other televised games that utilise a deck of playing cards.

The poker scene schematically illustrated in FIG. 1 is referred to here albeit with playing cards as configured in accordance with the present invention being referred to. Once a dealer 109 has dealt two cards to each player the poker action begins. The action starts with the players 104-108 located around the table looking at their own two cards that have been dealt to them. These two cards are commonly referred to as 'hole-cards'.

Figure 4:
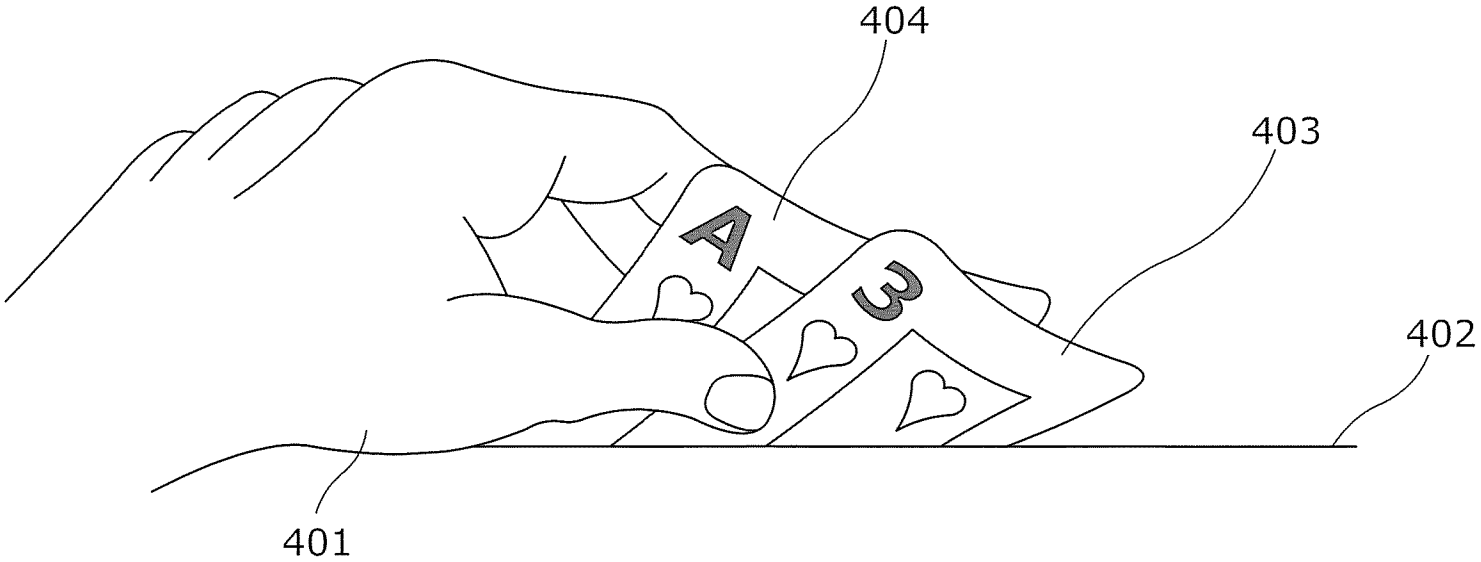
FIG. 4 schematically illustrates, in perspective view, two playing cards as are held in the hole-card viewing situation by a player and as are thus viewed by the player in a manner such that other players cannot ascertain the values of the cards, the figure specifically illustrating that the holographic image provided by the substantially transparent holographic optical element of FIG. 3 is not visible to the player.

FIG. 4 schematically illustrates, in perspective view, the two hole-cards as are held in the player hole-card viewing situation by a player 401 and as are thus viewed by player 401, following dealing of the cards onto the surface of the table 402. In the example, the hole-cards as have been dealt to player 401 include a three of hearts (playing card 403) and the ace of hearts (playing card 404). Thus playing cards 403 and 404 are shown in a configuration, such that the top third or half of each respective card is viewable by player 401. In the example player 401 can therefore see the card indicia and thus determine that card 404 is the ace of hearts and card 403 is the three of hearts.

Figure 5:
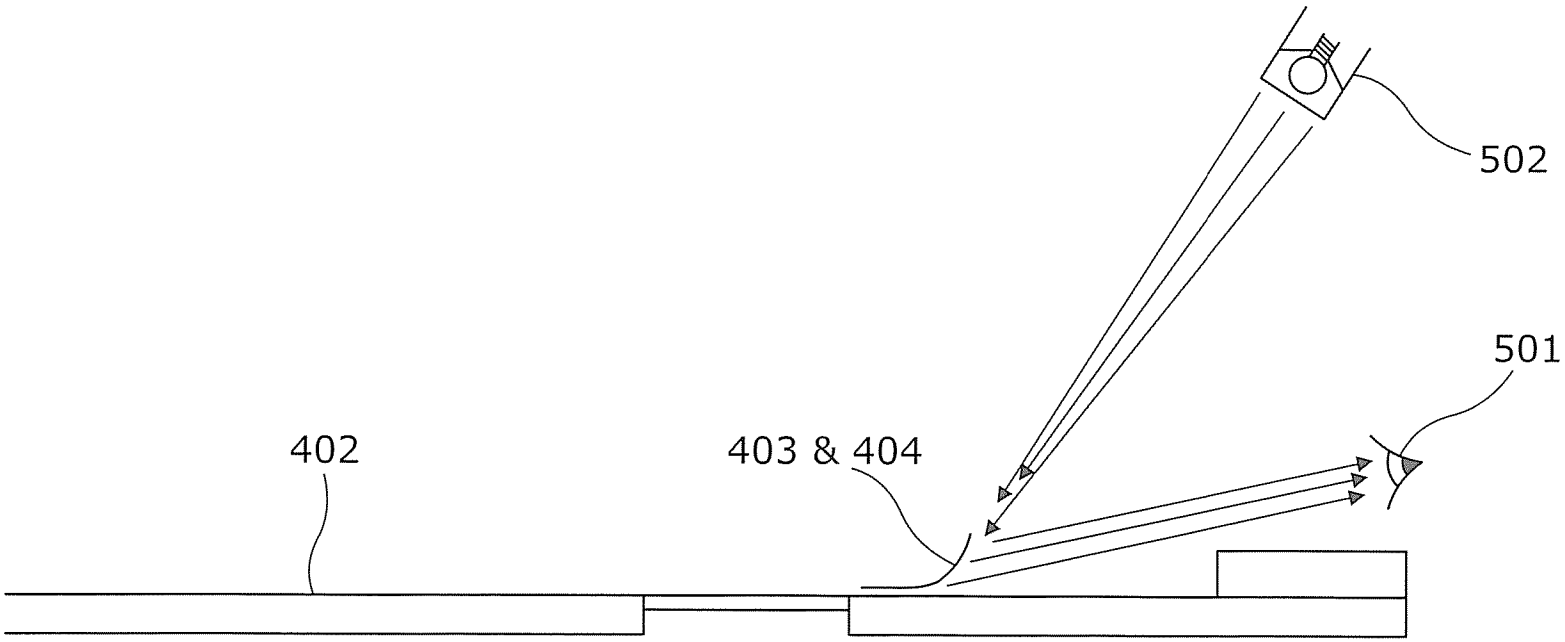
FIG. 5 schematically illustrates, in the form of a geometrical optics ray diagram, an example of typical ray paths associated with playing cards in the player hole-card viewing situation of FIG. 4.

FIG. 5 illustrates the same juncture (stage) of the game as FIG. 4, but as a geometrical optics ray diagram. Specifically FIG. 5 illustrates that playing cards 403 and 404 are thus held such that the visible portions of the front surface of the cards, relative to the players eyes 501 and an above the table surface light source 502, do not conform to the predetermined relative positioning parameters as to viewing angles and lighting angles that are required to view the additional subject matter that is housed in the respective substantially transparent holographic members of the front surfaces of respective playing cards 403 and 404. In the hole-card viewing situation of FIGS. 4 and 5, player 401 thus only sees the traditional playing card front face ink markings and therefore player 401 is not distracted or confused in his or her recognition of the hole-cards at this key juncture of the poker game.

Figures 2A, 2B:
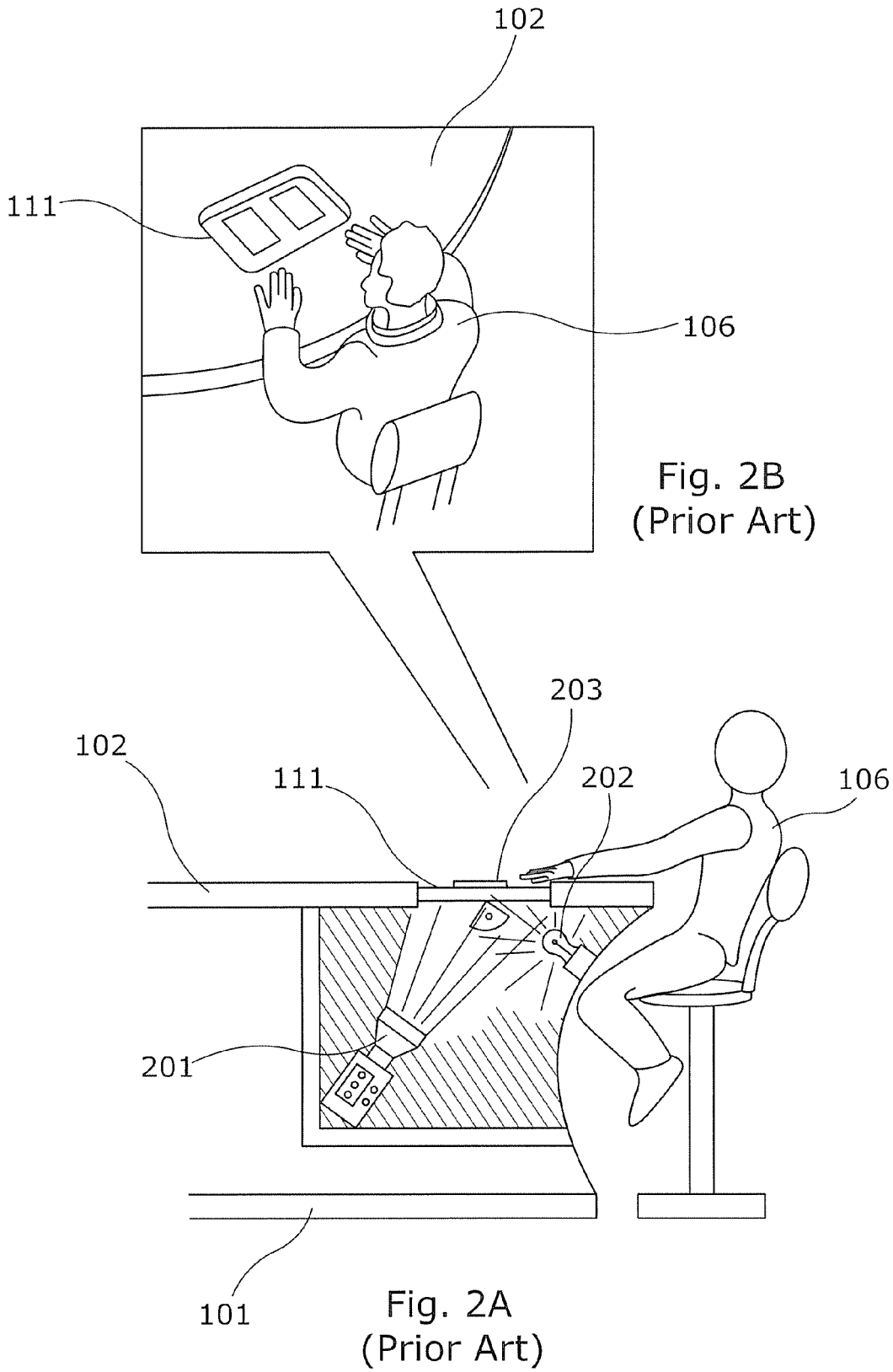
Fig. 2B (Prior Art)
Fig. 2A (Prior Art)
FIG. 2A further details, in side elevation/cross section view, the known poker tournament table of FIG. 1 and illustrates the relative position of a player with respect to a window on a surface of the poker table.
FIG. 2B further details, in perspective view from above the poker table surface, the player and window region as viewed by a camera located above the table surface and above head height of the dealer and players.
Figure 6:
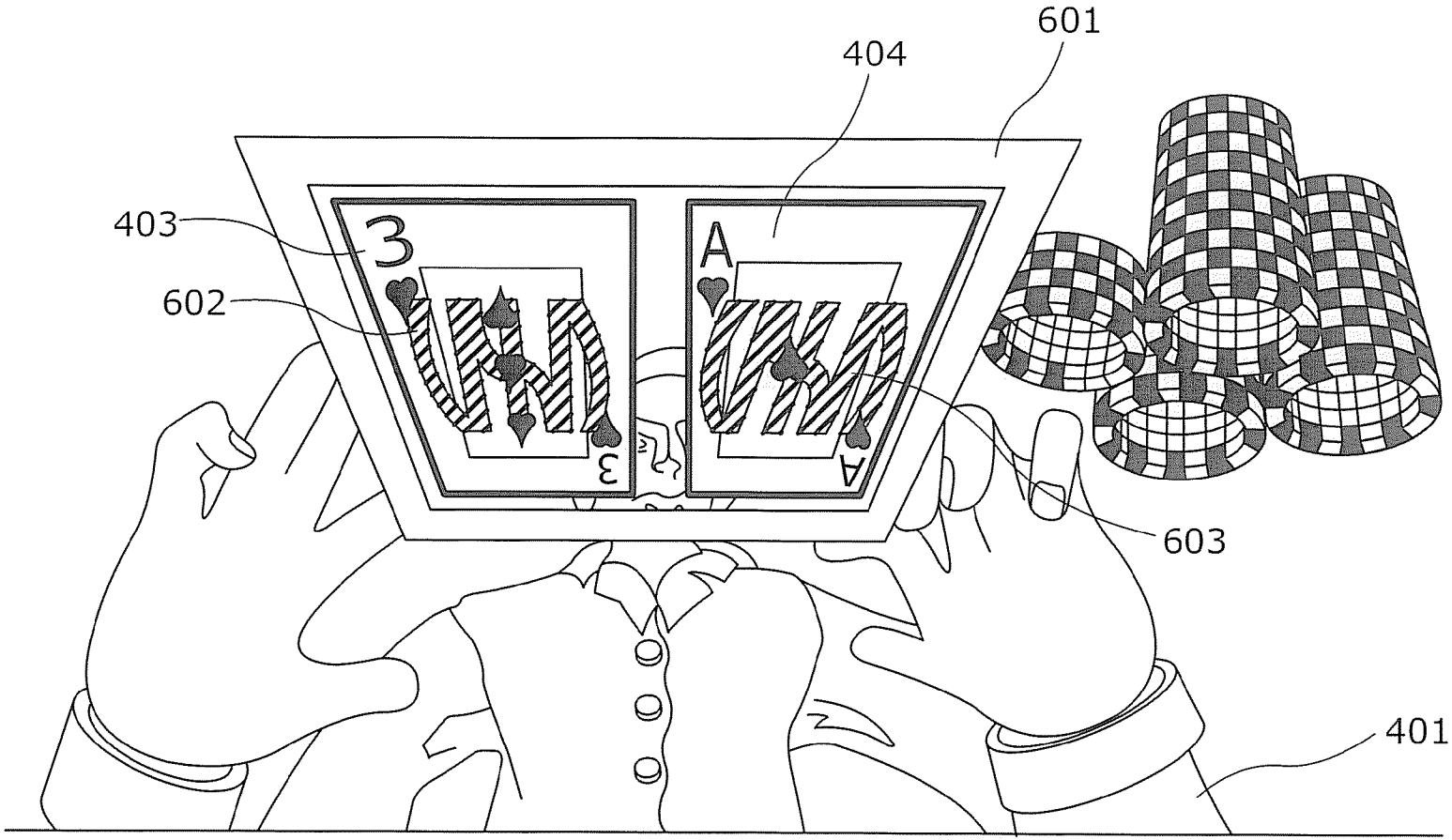
FIG. 6 schematically illustrates, in perspective view, the view as seen and imaged by an under-the-table hole-card TV camera of the type illustrated in FIG. 2A, the imaged scene being that of two hole-cards lying face down on a glass window on a poker table surface and a player looking at the window with a light source (lamp) located under the table being switched on in order to illuminate the faces of the cards such that the holographic image is visible by the electronic image receptor (TV camera)

Following the hole-card viewing by the player 401, both of the hole-cards are then typically placed side-by-side and face down on the window area of the poker table surface that is located in front of the player. FIG. 6 schematically illustrates, in perspective view, the view as imaged by an-under-the table hole-card TV camera of the type illustrated in FIG. 2A. FIG. 6 thus depicts player 401 sat at the table. The window on the poker table surface is indicated at 601 wherein the two hole-cards 403 and 404 have been placed thereon. The front faces of the hole-cards are illustrated in FIG. 6 by virtue of there being a light source (lamp) located under the table that is switched on in order to illuminate the faces of the cards. The view of the hole-cards is thus that of an under-the-table hole-card camera of the type 201 of FIG. 2A. This arrangement thus enables television viewers to see the front faces of the hole-cards of player 401 whilst the cards are lying on window 601 with their front faces facing window 601.

A principal application of the invention is described as follows. The light source positioned under the table that illuminates hole-cards 403 and 404 is required to be positioned at a predetermined angle relative to the hole-card TV camera and the position of the card surfaces, given the position of the window 601, on which the cards are placed. If the angles are set up correctly then the camera, focused on hole-cards 403 and 404, images the cards such that the indicia information is revealed as shown in FIG. 6 and also such that additional subject matter on the face of hole-cards 403 and 404 is able to be seen by the TV audience. In the example shown the additional subject matter is indicated, in respect of playing card 403, at 602 as the fanciful lettering 'VXD' and likewise at 603 in relation to hole-card 404. The additional subject matter 602 in respect of hole-card 403 and 603 in respect of hole-card 404 is that comprised within a holographic image as is provided by a substantially transparent holographic optical element as described earlier in relation to FIG. 3. The additional subject matter may comprise customised and/or personalised artwork, advertisements and various other types of images. The additional subject matter may thus include a sign that is configured to distinguish goods and/or services of a first commercial undertaking from those of other commercial undertakings and the holographic image may comprise alphanumeric characters and/or other symbols of one kind or another. The additional subject matter comprised within a holographic image as is illustrated in FIG. 6 only appears at a particular viewpoint or viewpoints as is/are predetermined prior to a given televised poker event and arranged accordingly for the event. In other words the visibility of the additional subject matter, (in the form of a holographic image) by the setting up of precise viewing angles and lighting arrangements for each viewpoint that is of interest, can thus be precisely controlled by the producers/organisers of the televised event.

Figure 7:
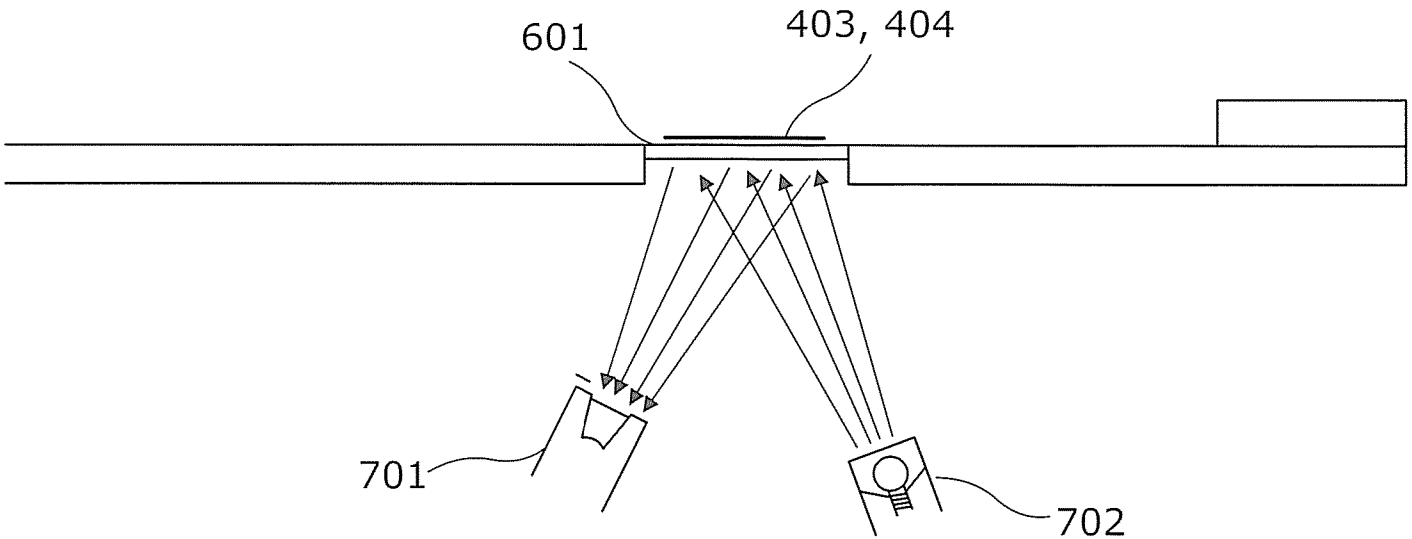
FIG. 7 schematically illustrates, in the form of a geometrical optics ray diagram, an example of preferred ray paths associated with playing cards in the TV camera hole-card viewing situation of FIG. 6, the figure further illustrating the use of an under-the-table hole-card camera in relation to a poker table of the type schematically illustrated in FIGS. 1, 2A, 2B an 4-6.

FIG. 7 illustrates the same juncture of the game as FIG. 6, but as a geometrical optics ray diagram. FIG. 7 illustrates that with appropriate positioning of an under the table hole-card TV camera 701 and under the table light source 702, relative to the card surfaces 403 and 404 when the cards are placed on the window 601, the conditions conform to the predetermined conditions that are required to view the additional subject matter that is housed in the respective substantially transparent holographic optical elements that are associated with the front surfaces of respective playing cards 403 and 404. Thus the holographic images embodied on the surfaces of cards 403 and 404 can be captured and recorded by hole-card TV camera 701 and transmitted to a TV audience.

Figure 8:
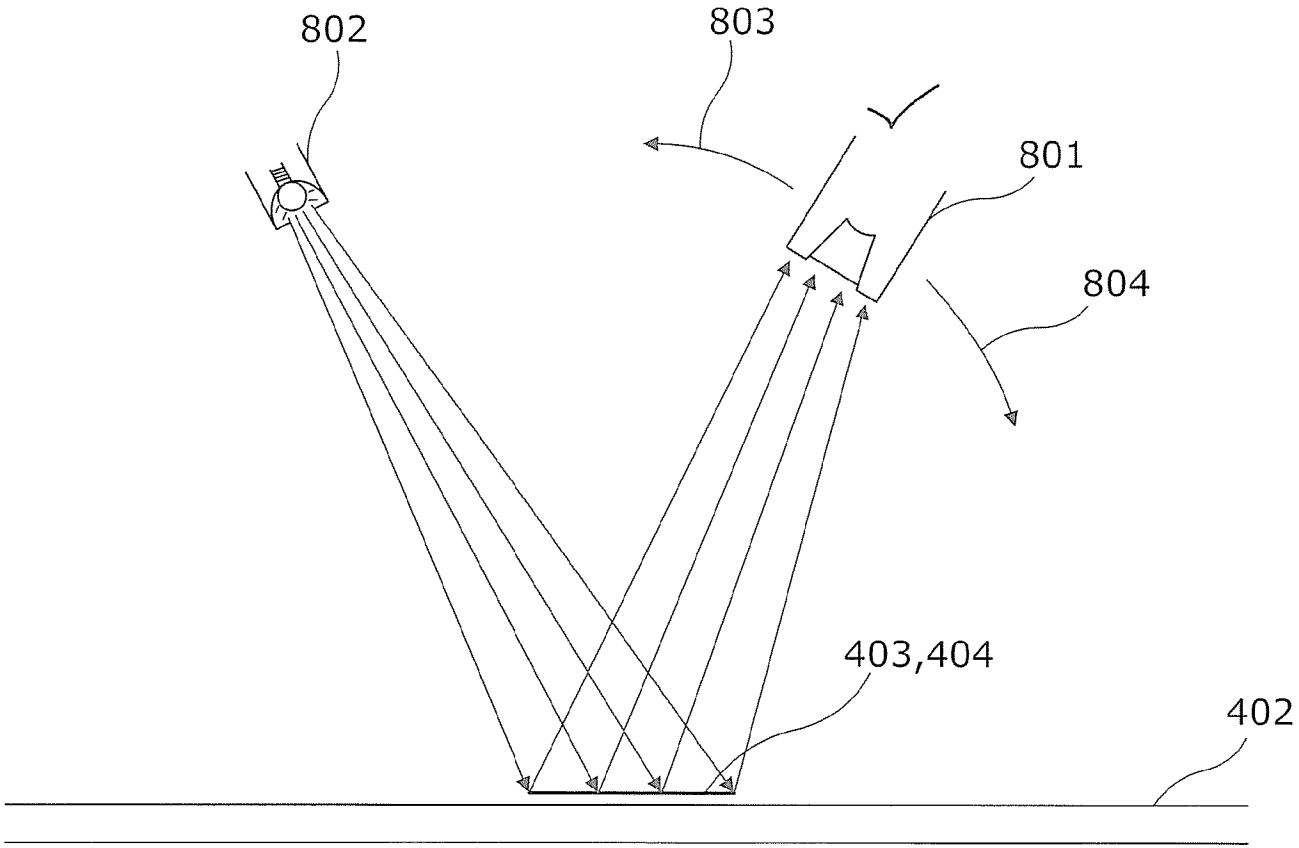
FIG. 8, in the form of a ray diagram, schematically illustrates a further example of preferred ray paths associated with a playing card, an image receptor and a light source with respect to a poker table surface of the type schematically illustrated in FIGS. 1, 2A, 2B and 4-7.

In order to further illustrate the conditions required to view additional subject matter housed in the substantially transparent holographic members of the present invention, reference is made to FIG. 8.

In accordance with the present invention FIG. 8, in the form of a ray diagram, schematically illustrates a further example of preferred ray paths associated with a playing card, an image receptor and a light source with respect to a poker table surface of the type schematically illustrated in FIGS. 1, 2A, 2B and 4-7. FIG. 8 depicts the same poker table surface 402 and respective cards 403, 404 as FIGS. 6 and 7, but at a later juncture in the game when the cards are exposed (shown face-up) so that the respective values of the cards may be viewed by one or persons in addition to the player in whose card hand the cards are a part of. At this juncture, cards may be placed at any position on the table, although typically they are placed in front of the dealer. In FIG. 8, a given card is facing upwards such that its front face that bears indicia markings is visible to an overhead image receptor 801. Image receptor 801 may comprise, for example, a TV camera and in the example shown, the image receptor is in a position substantially above the cards. In addition to image receptor 801 there is provided an overhead light source 802 that illuminates the face of the cards in a manner such that image receptor 801 is able to view the card identification elements on the front faces of the cards and also the holographic images that are present on the front faces of the playing cards. As in FIG. 6 and FIG. 7, this situation which permits the holographic images on the respective cards to be seen only occurs if the TV camera is suitably positioned and such that the lighting source 802 is also suitably positioned relative to the revealed faces of the cards and the image receptor 801. As described hereinbefore suitable positions relative to a given card surface are predetermined at the stage of manufacturing of a given card that comprises a substantially transparent holographic optical and an associated holographic image.

In respect of the viewing angle of camera 801 relative to the card surface of FIG. 8, in the best mode contemplated, the predetermined viewing and lighting angles that are required by virtue of their effectively being built in to the card at manufacture respectively, comprise those angles that are close to 90 degrees relative to the plane of a given surface of a card. In this context by 'close to' it is meant +/−10 degrees. Notwithstanding this preference other angles up to +/−45 degrees or even greater (wider) angles are also potentially preferable for certain other gaming situations that are contemplated by the inventor.

As is shown by respective arrows 803 and 804 image receptor 801, preferably a TV camera, may vary its angle of view from that shown in the figure such that it may be positioned directly overhead cards 403, 404 or moved to another angle relative to the front faces of the cards.

Starting from a direction that is overhead the cards 403, 404 (that is substantially perpendicular to the playing card surface of cards 403, 404) as camera 801 moves in the direction 804 towards the table surface there will come a point at which the holographic images that are identifiable on the front surface of the cards become impeded for a certain range of angles (a first range) as compared with a different range of angles (second range) wherein the holographic image is unimpeded. In the best mode contemplated the second range of directions is substantially symmetrical with respect to a reference direction that is perpendicular to the selected surface of the card. Additionally, in the best mode contemplated the second range of directions comprises, with respect to a reference direction that is perpendicular to the selected surface, the set of angles that are at 45 degrees or less to the reference direction.

Furthermore, in the best mode contemplated, a card as is configured in accordance with the present invention is such that the first range of directions comprises a subset of directions that are used by a player in a card game during the process of the player initially viewing and checking the value of the card, this process comprising, from a starting position wherein the card is lying face down, the card being handled by the player such that an edge portion of the card is brought into the subset of directions (of the first range) with respect to the direction that the card is viewed by the player, this subset of directions specifically being directions that in accordance with associated predetermined lighting conditions render the holographic image as substantially invisible to the eyes of the player.

Also in the best mode contemplated, a card as configured in accordance with the present invention is such that said second range of directions comprises a subset of directions outside of the first range that are used by an electronic image receptor, said subset of directions of said second range specifically being directions that in accordance with associated predetermined lighting conditions render said holographic image as substantially visible to said electronic image receptor.

In the exemplary sequence of actions of one typical hand of poker illustrated here, the holographic images as are provided by a playing card as configured in accordance with the present invention are formed on the same side of the cards which bear one or more card identification elements, (i.e. the front surface) as is the best mode contemplated.

In accordance with the present invention there is therefore provided a playing card which comprises a base layer that bears a front and a back surface and which also comprises a substantially planar holographic optical element that is operatively configured to form a holographic image, the holographic optical element, disposed at or towards the front surface of the card. However, those skilled in the art will appreciate that the face of the card comprising the holographic optical element may be varied such that it is selected from the front surface or the back surface and indeed a holographic optical element may be disposed at or towards both the front and back surfaces. Whatever the card face or faces selected, the holographic optical element associated with a given face is of a type that is substantially transparent and manufactured to substantially prevent said holographic image from being viewed in a first range of directions with respect to the selected surface and to substantially enable said holographic image to be viewed from a second range of directions that are outside of the first range.

Figure 9:
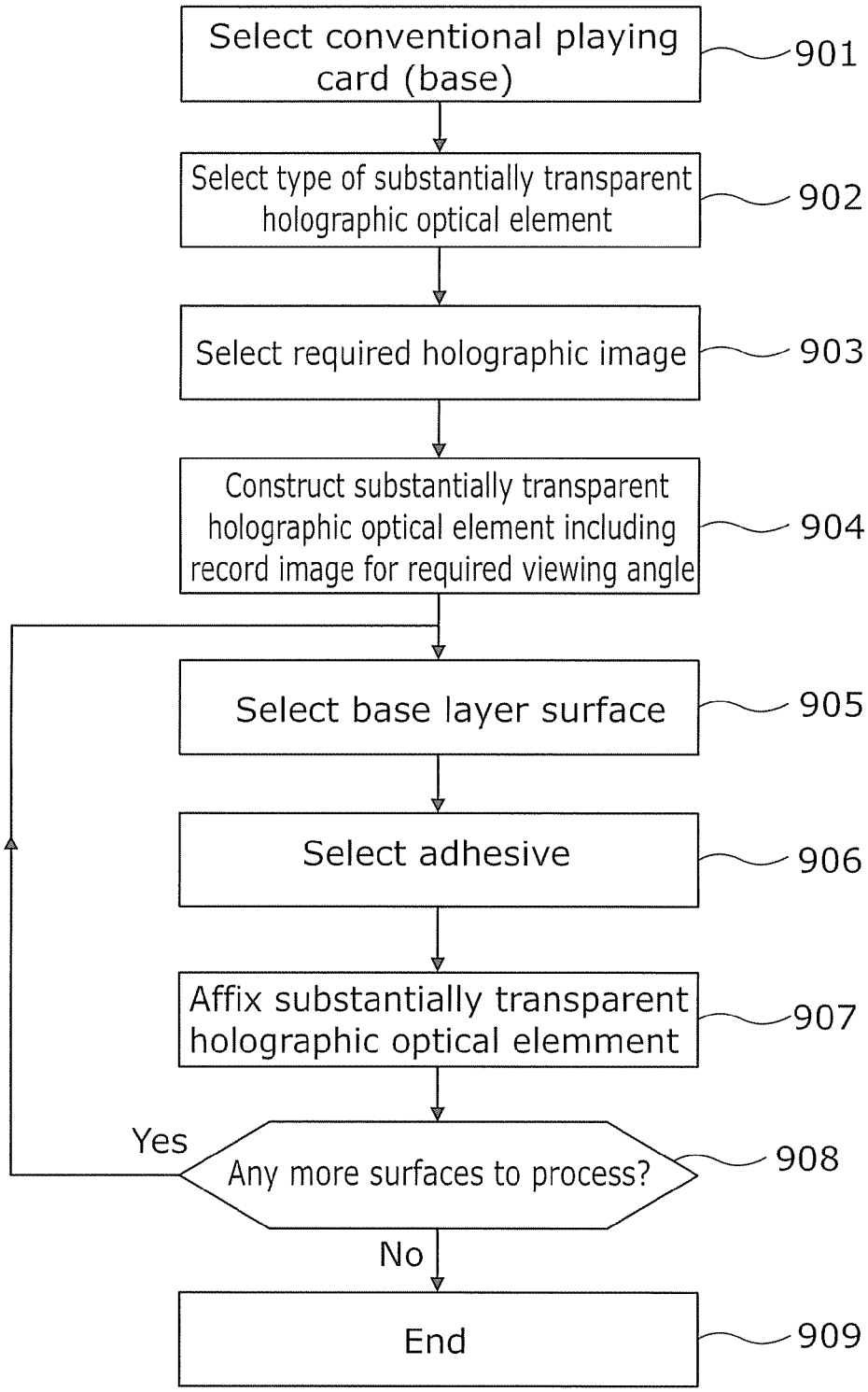
FIG. 9 schematically illustrates, in the form of a flow diagram the steps involved in constructing a playing card as configured in accordance with the present invention.

FIG. 9 schematically illustrates in the form of a flow diagram the steps involved in constructing a playing card as configured in accordance with the present invention.

The steps of FIG. 9 are generalised in order to cover the steps involved in creating a playing card irrespective of the exact type of substantially transparent holographic optical element that is selected. At step 901 a conventional playing card is selected for use as a base layer. At step 902 the type of substantially transparent optical element to be used is selected. This may be a HRI type holographic optical element as exemplified in FIG. 3, or it may, for example, be of the type that comprises a photopolymer-based layer, for example. Following step 902, at step 903 the required holographic image to be used on the card is selected according to a particular customer's requirements. Following step 903, at step 904 the substantially transparent holographic optical element is constructed in accordance with the selections made in steps 901-903. At step 904 the holographic image is recorded. Recording of the image is undertaken in accordance with selections made as to the required viewing and lighting angle (or angles)

as desired by a particular customer. In other words construction of the card involves the step of setting impeded and unimpeded viewing angles in relation to the holographic image stored on the card. In the best mode contemplated the unimpeded viewing angles comprise those angles from the normal to 45 degrees to the normal to the plane of the playing card surfaces that is selected. In the best mode the angles at which the holographic image is impeded are those at angles of 45 degrees or less to the plane of a surface of the card. Both these ranges of angles are however only broad approximations and are dependent on the relative predetermined parameters as to viewing angle(s) and lighting angle(s) that are set at the original creation/manufacture stage of the playing card. At step 904 various other constructional matters are attended to, which are dependent upon the type of substantially transparent holographic optical element selected at step 902. Thus, for example, to construct the holographic optical element of the example of FIG. 3 the sub-steps involved in step 904 include configuring outer layer 307 with a surface relief pattern 308 and fixing thereto a high refractive index layer 306.

Following construction at step 904 of the substantially transparent holographic optical element at step 905 the surface of the playing card that is required to be associated with a holographic image is selected. In the best mode contemplated the selected base layer surface is the front of surface of the card, which bears one or more card identification elements (indicia) that enables the card to be identified from other cards in a deck from which the card is a member. Once the surface of the card has been selected at step 905, at step 906 an adhesive is selected that is suitable for use with the card selected at step 901. In accordance with the present invention the adhesive must be selected such that the adhesive does not obscure the view of the face of the card selected at step 906. In other words the selected adhesive must be transparent or substantially transparent. Following selection of the adhesive at step 906, at step 907 the substantially transparent holographic optical element as constructed at step 904 is affixed, using the adhesive selected at step 906, to the base layer surface selected at step 905. Following step 907, at step 908 a question is asked as to whether or not there are any further surfaces to process. Thus if the surface selected at step 905 is the only surface to be associated with a holographic image then the answer to the question posed at step 908 will be in the negative and the process ends at step 909. However, if the question posed at step 908 is answered in the positive such that a further surface of the card selected at step 901 is required to incorporate a holographic image thereon then control is returned to step 905 wherein the further surface requiring a holographic image is selected with steps 906-909 following thereafter. This follows because the playing card selected at step 901 has only two surfaces and thus the question asked at step 908 is answered in the negative with the process thereby terminating at step 909.

The invention claimed is:

1. A deck of playing cards wherein at least one card comprises:

a base layer that bears a front surface and a back surface, with game markings disposed on the front surface; and a substantially planar holographic optical element disposed on the front surface and being operatively configured to form a holographic image of additional markings different from the game markings that are viewable over at least a portion of the front surface;

said holographic optical element being manufactured to produce said holographic image that is not viewable over a first range of directions that includes a viewing direction line normal to the front surface and extends to a second viewing line that subtends an acute angle with respect to the direction line normal to the front surface;

said holographic optical element being further manufactured to produce said holographic image that is viewable over a second range of directions that does not overlap the first range of directions;

said holographic optical element being of a type that is substantially transparent, to render viewable the game markings from both first and second range of directions.

2. A deck of playing cards as claimed in claim 1 wherein at least one of said surfaces bears one or more card identification elements configured to distinguish the card from other cards in the deck.

3. A deck of playing cards as claimed in claim 1 wherein at least one of said surfaces bears one or more card identification elements configured to distinguish the card from other cards in the deck and said holographic image is formed on the same side of said card as that which bears one or more card identification elements.

4. A deck of playing cards as claimed in claim 1 wherein at least one of said surfaces bears one or more card identification elements configured to distinguish the card from other cards in the deck and said one or more card identification elements substantially do not form part of said holographic image.

5. A deck of playing cards as claimed in claim 1 wherein at least one of said surfaces bears one or more card identification elements configured to distinguish the card from other cards in the deck and said holographic image substantially comprises an image of an entity other than of said one or more card identification elements.

6. A deck of playing cards as claimed in claim 1 wherein at least one of said surfaces bears one or more card identification elements configured to distinguish the card from other cards in the deck and said holographic image substantially comprises an image of an entity of said one or more card identification elements.

7. A deck of playing cards as claimed in claim 1 wherein said holographic optical element is specifically not associated with a metallised backing layer.

8. A deck of playing cards as claimed in claim 1 wherein said base layer is substantially made of a material from the set comprising plastics, paper and cardboard.

9. A deck of playing cards as claimed in claim 1 wherein said holographic optical element comprises a surface having specially configured undulations that facilitate formation of said holographic image.

10. A deck of playing cards as claimed in claim 1 wherein said holographic optical element is substantially planar.

11. A deck of playing cards as claimed in claim 1 wherein said holographic element is substantially in the form of a layer having substantially the same dimensions as said base layer.

12. A deck of playing cards as claimed in claim 1 wherein said holographic optical element comprises a high refracting index (HRI) medium as part of its construction.

13. A deck of playing cards as claimed in claim 1 wherein said holographic optical element substantially comprises a photopolymer based medium as part of its construction.

14. A deck of playing cards as claimed in claim 1 wherein said holographic optical element substantially comprises a selectively de-metallised based medium as part of its construction.

15. A deck of playing cards as claimed in claim 1 wherein at least one of said first and second ranges are, during manufacture of said at least one card, substantially predetermined and said optical element is configured to provide said specified visibility requirements of each respective range in accordance with a substantially predefined relative positional arrangement as between said front card surface, a light source and an image receptor.

16. A deck of playing cards as claimed in claim 1 wherein said second range of directions is substantially symmetrical with respect to a reference direction that is perpendicular to said front surface.

17. A deck of playing cards as claimed in claim 1 wherein said holographic optical element is mechanically embossed on its outer surface in order to reduce gloss.

18. A deck of playing cards as claimed in claim 1 wherein said deck of cards is configured for use in a card game that is electronically imaged for transmission to an audience of one or more spectators.

19. A deck of playing cards as claimed in claim 1 wherein said deck of cards is configured for use in a televised card game.

20. A deck of playing cards as claimed in claim 1 wherein said deck of cards is configured for use in a professional card game.

21. A deck of playing cards as claimed in claim 1 wherein said deck of cards is configured for use in the game of poker.

22. A deck of playing cards as claimed in claim 1 wherein said holographic image comprises a sign that is configured to distinguish goods and/or services of a first commercial undertaking from those of other commercial undertakings.

23. A deck of playing cards as claimed in claim 1 wherein said holographic image comprises a sign that is configured to distinguish goods and/or services of a first commercial undertaking from those of other commercial undertakings and said sign comprises one or more alphanumeric characters.

24. A deck of playing cards as claimed in claim 1 wherein said card is configured such that said first range of directions comprises a subset of directions that are used by a player in a card game during the process of said player initially viewing and checking the value of said card, said process comprising, from a starting position wherein said card is lying face down, said card being handled by said player such that an edge portion of said card is brought into said subset of directions with respect to the direction that said card is viewed by said player, said subset of directions specifically being directions that in accordance with associated predetermined lighting conditions render said holographic image as substantially invisible to the eyes of said player.

25. A deck of playing cards as claimed in claim 1 wherein said card is configured such that when said card is used in a card game said second range of directions comprises a subset of directions outside of said first range, that are used by an electronic image receptor, said subset of directions of said second range specifically being directions that in accordance with associated predetermined lighting conditions render said holographic image as substantially visible to said electronic image receptor.

26. A playing card comprising:

a base layer that bears a front surface and a back surface, with game markings disposed on the front surface; and a substantially planar holographic optical element disposed on the front surface and being operatively configured to form a holographic image of additional markings different from the game markings that are viewable over at least a portion of the front surface;

said holographic optical element being manufactured to produce said holographic image that is not viewable over a first range of directions that includes a viewing direction line normal to the front surface and extends to a second viewing line that subtends an acute angle with respect to the direction line normal to the front surface;

said holographic optical element being further manufactured to produce said holographic image that is viewable over a second range of directions that does not overlap the first range of directions;

said holographic optical element being of a type that is substantially transparent, to render viewable the game markings from both first and second range of directions.

27. A playing card as claimed in claim 26 wherein said card is configured such that said first range of directions comprises a subset of directions that are used by a player in a card game during the process of said player initially viewing and checking the value of said card, said process comprising, from a starting position wherein said card is lying face down, said card being handled by said player such that an edge portion of said card is brought into said subset of directions with respect to the direction that said card is viewed by said player, said subset of directions specifically being directions that in accordance with associated predetermined lighting conditions render said holographic image as substantially invisible to the eyes of said player.

28. A playing card as claimed in claim 26 wherein said card is configured such that when said card is used in a card game said second range of directions comprises a subset of directions outside of said first range that are used by an electronic image receptor, said subset of directions of said second range specifically being directions that in accordance with associated predetermined lighting conditions render said holographic image as substantially visible to said electronic image receptor.

* * * * *